US008579658B2

(12) United States Patent
Youtsey

(10) Patent No.: US 8,579,658 B2
(45) Date of Patent: Nov. 12, 2013

(54) COAXIAL CABLE CONNECTORS WITH WASHERS FOR PREVENTING SEPARATION OF MATED CONNECTORS

(76) Inventor: Timothy L. Youtsey, Scottsdale, AZ (US)

( * ) Notice: Subject to any disclaimer, the term of this patent is extended or adjusted under 35 U.S.C. 154(b) by 0 days.

(21) Appl. No.: 13/213,823

(22) Filed: Aug. 19, 2011

(65) Prior Publication Data

US 2012/0045933 A1 Feb. 23, 2012

Related U.S. Application Data

(60) Provisional application No. 61/454,089, filed on Mar. 18, 2011, provisional application No. 61/375,779, filed on Aug. 20, 2010.

(51) Int. Cl.
*H01R 9/05* (2006.01)

(52) U.S. Cl.
USPC ..... 439/578

(58) Field of Classification Search
USPC ..... 439/578–585, 322, 20, 23, 28; 29/857
See application file for complete search history.

(56) References Cited

U.S. PATENT DOCUMENTS

| | | | |
|---|---|---|---|
| 2,178,365 | A | 10/1939 | Brobst |
| 2,232,846 | A | 2/1941 | Freydberg |
| 2,233,216 | A | 2/1941 | Matthysse |
| 2,304,711 | A | 12/1942 | Shenton |
| D140,861 | S | 4/1945 | Conlan |
| 2,669,695 | A | 9/1952 | Bird |
| 3,076,235 | A | 2/1963 | Rollins et al. |
| 3,274,447 | A | 9/1966 | Nelson |
| 3,275,737 | A | 9/1966 | Caller |
| 3,344,227 | A | 9/1967 | Gilmartin et al. |
| 3,366,920 | A | 1/1968 | Laudig et al. |
| 3,229,623 | A | 4/1968 | Kempf |
| 3,379,824 | A | 4/1968 | Kempf |
| 3,390,374 | A | 6/1968 | Forney, Jr. |
| 3,489,988 | A | 1/1970 | Carnaghan |
| 3,517,375 | A | 6/1970 | Mancini |
| 3,544,705 | A | 12/1970 | Winston |

(Continued)

FOREIGN PATENT DOCUMENTS

| | | |
|---|---|---|
| DE | 3111832 A1 | 10/1982 |
| DE | 10050445 | 4/2002 |

(Continued)

OTHER PUBLICATIONS

U.S. Appl. No. 13/118,807, filed May 19, 2011, Youtsey.

(Continued)

*Primary Examiner* — Chandrika Prasad

(57) ABSTRACT

Coaxial cable connectors including washers are described herein. A coaxial cable connector configured in accordance with an embodiment of the present technology includes a conductive insert, a coupling nut, and a washer. The coupling nut can include a first end portion, a second end portion, and an inner surface defining a bore for receiving a corresponding coaxial cable connector. The conductive insert can include an annular flange at least partially surrounded by the bore. The washer can be positioned between the second end portion of the coupling nut and the annular flange, and can be configured to press against at least one of the annular flange and the second end portion of the coupling nut to restrict rotation between the coaxial cable connectors.

16 Claims, 13 Drawing Sheets

(56) References Cited

U.S. PATENT DOCUMENTS

| | | | |
|---|---|---|---|
| 3,601,776 | A | 8/1971 | Curl |
| 3,609,651 | A | 9/1971 | Sladek et al. |
| 3,653,689 | A | 4/1972 | Sapy et al. |
| 3,662,090 | A | 5/1972 | Grey |
| 3,671,922 | A | 6/1972 | Zerlin et al. |
| 3,708,781 | A | 1/1973 | Trompeter |
| 3,740,453 | A | 6/1973 | Callaghan et al. |
| 3,746,931 | A | 7/1973 | Muranaka |
| 3,777,298 | A | 12/1973 | Newman |
| 3,778,535 | A | 12/1973 | Forney, Jr. |
| 3,836,700 | A | 9/1974 | Niemeyer |
| 3,863,111 | A | 1/1975 | Martzloff |
| 4,029,006 | A | 6/1977 | Mercer |
| 4,096,346 | A | 6/1978 | Stine et al. |
| 4,100,003 | A | 7/1978 | Trusch |
| 4,117,260 | A | 9/1978 | Wilkenloh |
| 4,125,739 | A | 11/1978 | Bow |
| 4,159,859 | A | 7/1979 | Shemtov |
| 4,221,926 | A | 9/1980 | Schneider |
| 4,225,162 | A | 9/1980 | Dola |
| 4,307,926 | A | 12/1981 | Smith |
| 4,371,742 | A | 2/1983 | Manly |
| 4,400,050 | A | 8/1983 | Hayward |
| 4,408,822 | A | 10/1983 | Nikitas |
| 4,439,632 | A | 3/1984 | Aloisio et al. |
| 4,465,717 | A | 8/1984 | Crofts et al. |
| 4,472,595 | A | 9/1984 | Fox et al. |
| 4,484,023 | A | 11/1984 | Gindrup |
| 4,509,090 | A | 4/1985 | Kawanami et al. |
| 4,515,992 | A | 5/1985 | Gupta |
| RE31,995 | E | 10/1985 | Ball |
| 4,557,560 | A | 12/1985 | Bohannon, Jr. et al. |
| 4,564,723 | A | 1/1986 | Lang |
| 4,569,704 | A | 2/1986 | Bohannon, Jr. et al. |
| 4,572,692 | A | 2/1986 | Sauber |
| 4,595,431 | A | 6/1986 | Bohannon, Jr. et al. |
| 4,604,773 | A | 8/1986 | Weber et al. |
| 4,619,497 | A | 10/1986 | Vogel et al. |
| 4,633,359 | A | 12/1986 | Mickelson et al. |
| 4,641,110 | A | 2/1987 | Smith |
| 4,684,201 | A | 8/1987 | Hutter |
| 4,691,081 | A | 9/1987 | Gupta |
| 4,718,854 | A | 1/1988 | Capp et al. |
| 4,729,629 | A | 3/1988 | Saito et al. |
| 4,755,152 | A | 7/1988 | Elliot et al. |
| 4,760,362 | A | 7/1988 | Maki |
| 4,774,148 | A | 9/1988 | Goto |
| 4,875,864 | A | 10/1989 | Campbell |
| 4,894,488 | A | 1/1990 | Gupta |
| 4,915,651 | A | 4/1990 | Bout |
| 4,965,412 | A | 10/1990 | Lai |
| 4,990,106 | A | 2/1991 | Szegda |
| 4,997,994 | A | 3/1991 | Andrews et al. |
| 5,011,432 | A | 4/1991 | Sucht et al. |
| 5,041,020 | A | 8/1991 | Michael |
| 5,043,538 | A | 8/1991 | Hughey, Jr. et al. |
| 5,043,539 | A | 8/1991 | Connole et al. |
| 5,049,721 | A | 9/1991 | Parnas et al. |
| 5,073,129 | A | 12/1991 | Szegda |
| 5,083,943 | A | 1/1992 | Tarrant |
| 5,096,444 | A | 3/1992 | Lu et al. |
| 5,123,863 | A | 6/1992 | Frederick et al. |
| 5,132,491 | A | 7/1992 | Mulrooney et al. |
| 5,141,448 | A | 8/1992 | Mattingly et al. |
| 5,145,382 | A | 9/1992 | Dickirson |
| 5,147,221 | A | 9/1992 | Cull et al. |
| 5,161,993 | A | 11/1992 | Leibfried, Jr. |
| 5,195,905 | A | 3/1993 | Pesci |
| 5,195,910 | A | 3/1993 | Enomoto et al. |
| 5,198,958 | A | 3/1993 | Krantz, Jr. |
| 5,205,547 | A | 4/1993 | Mattingly |
| 5,216,202 | A | 6/1993 | Yoshida et al. |
| 5,217,393 | A | 6/1993 | Del Negro et al. |
| 5,237,293 | A | 8/1993 | Kan et al. |
| 5,276,415 | A | 1/1994 | Lewandowski et al. |
| 5,281,167 | A | 1/1994 | Le et al. |
| 5,284,449 | A | 2/1994 | Vaccaro |
| 5,295,864 | A | 3/1994 | Birch et al. |
| 5,306,170 | A | 4/1994 | Luu |
| 5,316,348 | A | 5/1994 | Franklin |
| 5,318,458 | A | 6/1994 | Thorner |
| 5,329,064 | A | 7/1994 | Tash |
| 5,355,720 | A | 10/1994 | Bailey |
| 5,367,925 | A | 11/1994 | Gasparre |
| 5,412,856 | A | 5/1995 | Nazerian et al. |
| 5,414,213 | A | 5/1995 | Hillburn |
| 5,439,399 | A | 8/1995 | Spechts et al. |
| 5,470,257 | A | 11/1995 | Szegda |
| 5,471,144 | A | 11/1995 | Meyer et al. |
| 5,498,175 | A | 3/1996 | Yeh et al. |
| 5,507,537 | A | 4/1996 | Meisinger et al. |
| 5,525,076 | A | 6/1996 | Down |
| 5,548,088 | A | 8/1996 | Gray et al. |
| 5,560,536 | A | 10/1996 | Moe |
| 5,564,938 | A | 10/1996 | Shenkal et al. |
| 5,595,499 | A | 1/1997 | Zander et al. |
| 5,607,325 | A | 3/1997 | Toma |
| 5,632,633 | A | 5/1997 | Roosdorp et al. |
| 5,632,651 | A | 5/1997 | Szegda |
| 5,651,698 | A | 7/1997 | Locati et al. |
| 5,660,565 | A | 8/1997 | Williams |
| 5,667,409 | A | 9/1997 | Wong et al. |
| 5,700,160 | A | 12/1997 | Lee |
| 5,707,465 | A | 1/1998 | Bibber |
| 5,719,353 | A | 2/1998 | Carlson et al. |
| 5,724,220 | A | 3/1998 | Chaudhry |
| 5,730,622 | A | 3/1998 | Olson |
| 5,796,042 | A | 8/1998 | Pope |
| 5,829,992 | A | 11/1998 | Merker et al. |
| 5,830,010 | A | 11/1998 | Miskin et al. |
| 5,857,711 | A | 1/1999 | Comin-DuMong et al. |
| 5,860,833 | A | 1/1999 | Chillscyzn et al. |
| 5,863,226 | A | 1/1999 | Lan et al. |
| 5,865,654 | A | 2/1999 | Shimirak et al. |
| 5,882,233 | A | 3/1999 | Idehara |
| 5,926,949 | A | 7/1999 | Moe et al. |
| 5,927,975 | A | 7/1999 | Esrock |
| 5,938,465 | A | 8/1999 | Fox, Sr. |
| 5,945,632 | A | 8/1999 | Butera |
| 5,949,018 | A | 9/1999 | Esker |
| 5,953,195 | A | 9/1999 | Pagliuca |
| 5,959,245 | A | 9/1999 | Moe et al. |
| 5,969,295 | A | 10/1999 | Boucino et al. |
| 5,984,378 | A | 11/1999 | Ostrander et al. |
| 5,991,136 | A | 11/1999 | Kaczmarek et al. |
| 6,010,349 | A | 1/2000 | Porter, Jr. |
| 6,011,218 | A | 1/2000 | Burek et al. |
| 6,024,408 | A | 2/2000 | Bello |
| 6,027,373 | A | 2/2000 | Gray et al. |
| 6,037,545 | A | 3/2000 | Fox et al. |
| 6,042,422 | A | 3/2000 | Youtsey |
| 6,048,233 | A | 4/2000 | Cole |
| 6,065,997 | A | 5/2000 | Wang |
| 6,071,144 | A | 6/2000 | Tang |
| 6,087,017 | A | 7/2000 | Bibber |
| 6,109,963 | A | 8/2000 | Follingstad et al. |
| 6,113,431 | A | 9/2000 | Wong |
| 6,127,441 | A | 10/2000 | Sakamoto et al. |
| 6,137,058 | A | 10/2000 | Moe et al. |
| 6,140,582 | A | 10/2000 | Sheehan |
| 6,142,788 | A | 11/2000 | Han |
| 6,146,196 | A | 11/2000 | Burger et al. |
| 6,148,130 | A | 11/2000 | Lee et al. |
| 6,174,206 | B1 | 1/2001 | Yentile et al. |
| 6,183,297 | B1 | 2/2001 | Kay et al. |
| 6,183,298 | B1 | 2/2001 | Henningsen |
| 6,201,189 | B1 | 3/2001 | Carlson et al. |
| 6,201,190 | B1 | 3/2001 | Pope |
| 6,204,445 | B1 | 3/2001 | Gialenios et al. |
| 6,210,221 | B1 | 4/2001 | Maury |
| 6,210,222 | B1 | 4/2001 | Langham et al. |
| 6,246,006 | B1 | 6/2001 | Hardin et al. |
| 6,249,415 | B1 | 6/2001 | Daoud et al. |
| 6,250,960 | B1 | 6/2001 | Youtsey |

(56) References Cited

U.S. PATENT DOCUMENTS

| | | | | |
|---|---|---|---|---|
| 6,265,667 | B1 | 7/2001 | Stipes et al. | |
| 6,282,778 | B1 | 9/2001 | Fox et al. | |
| 6,288,628 | B1 | 9/2001 | Fujimori | |
| 6,326,551 | B1 | 12/2001 | Adams | |
| 6,371,585 | B2 | 4/2002 | Kurachi | |
| 6,372,990 | B1 | 4/2002 | Saito et al. | |
| 6,384,337 | B1 | 5/2002 | Drum | |
| 6,396,367 | B1 | 5/2002 | Rosenberger | |
| D459,306 | S | 6/2002 | Malin | |
| 6,417,454 | B1 | 7/2002 | Biebuyck | |
| 6,450,836 | B1 | 9/2002 | Youtsey | |
| 6,462,436 | B1 | 10/2002 | Kay et al. | |
| 6,468,100 | B1 | 10/2002 | Meyer et al. | |
| 6,498,301 | B1 | 12/2002 | Pieper et al. | |
| 6,540,293 | B1 | 4/2003 | Quackenbush | |
| 6,545,222 | B2 | 4/2003 | Yokokawa et al. | |
| 6,591,055 | B1 | 7/2003 | Eslambolchi et al. | |
| 6,596,393 | B1 | 7/2003 | Houston et al. | |
| 6,610,931 | B2 | 8/2003 | Perelman et al. | |
| 6,648,683 | B2 | 11/2003 | Youtsey | |
| 6,712,631 | B1 | 3/2004 | Youtsey | |
| 6,734,364 | B2 | 5/2004 | Price et al. | |
| 6,770,819 | B2 | 8/2004 | Patel | |
| 6,798,310 | B2 | 9/2004 | Wong et al. | |
| 6,800,809 | B2 | 10/2004 | Moe et al. | |
| 6,800,811 | B1 | 10/2004 | Boucino | |
| 6,818,832 | B2 | 11/2004 | Hopkinson et al. | |
| 6,846,536 | B1 | 1/2005 | Priesnitz et al. | |
| 6,848,939 | B2 | 2/2005 | Stirling | |
| 6,858,805 | B2 | 2/2005 | Blew et al. | |
| 6,875,928 | B1 | 4/2005 | Hayes et al. | |
| 6,877,996 | B1 | 4/2005 | Franks, Jr. | |
| 6,915,564 | B2 | 7/2005 | Adams | |
| D508,676 | S | 8/2005 | Franks, Jr. | |
| 6,997,999 | B2 | 2/2006 | Houston et al. | |
| 7,022,918 | B2 | 4/2006 | Gialenios et al. | |
| 7,077,475 | B2 | 7/2006 | Boyle | |
| 7,084,343 | B1 | 8/2006 | Visser | |
| 7,127,806 | B2 | 10/2006 | Nelson et al. | |
| 7,131,868 | B2 | 11/2006 | Montena | |
| 7,144,273 | B1 | 12/2006 | Chawgo | |
| 7,147,509 | B1 | 12/2006 | Burris et al. | |
| 7,157,645 | B2 | 1/2007 | Huffman | |
| 7,159,948 | B1 | 1/2007 | Wolf | |
| 7,183,743 | B2 | 2/2007 | Geiger | |
| 7,198,495 | B1 | 4/2007 | Youtsey | |
| 7,278,684 | B2 | 10/2007 | Boyle | |
| 7,299,550 | B2 | 11/2007 | Montena | |
| 7,306,484 | B1 | 12/2007 | Mahoney et al. | |
| 7,311,555 | B1 | 12/2007 | Burris et al. | |
| 7,314,998 | B2 | 1/2008 | Amato et al. | |
| 7,350,767 | B2 | 4/2008 | Huang | |
| 7,404,737 | B1 | 7/2008 | Youtsey | |
| 7,468,489 | B2 | 12/2008 | Alrutz | |
| 7,497,002 | B2 | 3/2009 | Chawgo | |
| 7,500,874 | B2 | 3/2009 | Montena | |
| 7,507,117 | B2 | 3/2009 | Amidon | |
| 7,513,795 | B1 | 4/2009 | Shaw | |
| 7,566,236 | B2 * | 7/2009 | Malloy et al. | 439/321 |
| 7,635,283 | B1 * | 12/2009 | Islam | 439/583 |
| 7,785,144 | B1 * | 8/2010 | Islam | 439/583 |
| 7,837,501 | B2 | 11/2010 | Youtsey | |
| 7,841,912 | B2 | 11/2010 | Hachadorian | |
| 7,857,661 | B1 * | 12/2010 | Islam | 439/584 |
| 7,887,354 | B2 | 2/2011 | Holliday | |
| 8,062,064 | B2 * | 11/2011 | Rodrigues et al. | 439/578 |
| 8,075,338 | B1 | 12/2011 | Montena | |
| 8,079,860 | B1 | 12/2011 | Zraik | |
| 8,113,875 | B2 | 2/2012 | Malloy et al. | |
| 8,113,879 | B1 | 2/2012 | Zraik | |
| 8,152,551 | B2 * | 4/2012 | Zraik | 439/322 |
| 8,157,589 | B2 | 4/2012 | Krenceski | |
| 8,206,176 | B2 * | 6/2012 | Islam | 439/578 |
| 2002/0090856 | A1 | 7/2002 | Weisz-Margulescu | |
| 2003/0044606 | A1 | 3/2003 | Iskander | |
| 2004/0007308 | A1 | 1/2004 | Houston et al. | |
| 2004/0112356 | A1 | 6/2004 | Hatcher | |
| 2004/0222009 | A1 | 11/2004 | Blew et al. | |
| 2005/0042960 | A1 | 2/2005 | Yeh et al. | |
| 2005/0272310 | A1 | 12/2005 | Tsao | |
| 2006/0041922 | A1 | 2/2006 | Shapson | |
| 2006/0154522 | A1 | 7/2006 | Bernhart et al. | |
| 2006/0172571 | A1 | 8/2006 | Montena | |
| 2007/0291462 | A1 | 12/2007 | Peng | |
| 2010/0033001 | A1 | 2/2010 | Boyer | |
| 2010/0276176 | A1 | 11/2010 | Amato | |
| 2011/0011638 | A1 | 1/2011 | Gemme | |
| 2011/0011639 | A1 | 1/2011 | Visser | |
| 2011/0287653 | A1 | 11/2011 | Youtsey | |
| 2011/0318958 | A1 * | 12/2011 | Burris et al. | 439/578 |
| 2012/0129387 | A1 * | 5/2012 | Holland et al. | 439/578 |

FOREIGN PATENT DOCUMENTS

| | | | |
|---|---|---|---|
| EP | 1075698 | | 11/1999 |
| EP | 1335390 | | 8/2003 |
| GB | 2079549 | A | 1/1982 |
| JP | 64002263 | A | 1/1989 |
| JP | 2299182 | A | 12/1990 |
| JP | 05347170 | A | 12/1993 |
| JP | 2004128158 | | 4/2004 |
| WO | WO-9310578 | A1 | 5/1993 |
| WO | WO-03013848 | | 2/2003 |
| WO | WO-2005006353 | | 1/2005 |
| WO | WO2011009006 | | 1/2011 |
| WO | WO-2011146911 | | 11/2011 |
| WO | WO-2012158343 | | 11/2012 |
| WO | WO-2012158344 | | 11/2012 |
| WO | WO-2012158345 | | 11/2012 |

OTHER PUBLICATIONS

U.S. Appl. No. 13/118,817, filed May 19, 2011, Youtsey.

U.S. Appl. No. 13/118,826, filed May 19, 2011, Youtsey.

"F-type connectors", ShowMe Cables, dated 2007 and printed on Jul. 9, 2008, 1 page, located at: http://www.showmecables.com/F-Type-Connectors.html.

Latest quality F-connector Supply Information, China Quality F Connector list, Hardware-Wholesale.com, printed on Jul. 9, 2008, 6 pages, located at: http://www.hardware-wholesale.com/buy-F_Connector/.

"Pico/Macom GRB-I" and "Pico/Macom GRB-2" single and dual coax cable ground blocks, Stallions Satellite and Antenna—Grounding Products, dated Nov. 9, 2005 and printed Aug. 17, 2011, 3 pgs., located online at: http://web.archive.org/web/20051109024213/http://tvantenna.com/products/installation/grounding.html.

* cited by examiner

COAXIAL CABLE CONNECTORS WITH WASHERS FOR PREVENTING SEPARATION OF MATED CONNECTORS

CROSS-REFERENCE TO RELATED APPLICATION(S)

This application claims priority to and the benefit of U.S. Provisional Patent Application No. 61/454,089, filed Mar. 18, 2011, entitled "COAXIAL CABLE CONNECTORS AND ASSOCIATED WASHERS" and U.S. Provisional Patent Application No. 61/375,779, filed Aug. 20, 2010, entitled "F-CONNECTOR WITH EXPANSION WASHER," both of which are incorporated herein by reference in their entireties.

TECHNICAL FIELD

The present technology relates to coaxial cable connectors that include expansion washers, non-planar washers, and other features to prevent loosening or separation of mated connectors.

BACKGROUND

Electrical connectors are used in a variety of applications to interconnect electrical circuits and devices. One such connector is an F-connector, which is used on most radio frequency (RF) coaxial cables to interconnect TVs, cable TV decoders, VCR/DVD's, hard disk digital recorders, satellite receivers, and other devices. F-connectors generally include a male coaxial cable connector that houses a center conductor (e.g., central wire) and a corresponding female coaxial connector that houses contacts that receive the center conductor. Male coaxial cable connectors typically have a standardized design, generally using a 7/16 inch hex nut as a fastener. The nut has a relatively short (e.g., 1/8 to 1/4 inch) length and can be grasped by a person's fingers to be tightened or loosened.

A number of factors, including vibration and thermal cycling, can cause mated male and female F-connectors to loosen and/or separate, resulting in signal loss or degradation of electrical performance. Additionally, when used outdoors, conventional F-connectors can be vulnerable to intrusion by moisture and dust, which can corrode portions connectors can be vulnerable to intrusion by moisture and dust, which can corrode portions of the F-connector (or the cable to which it is attached) or otherwise degrade the performance of the connection.

DETAILED DESCRIPTION

The present disclosure describes various embodiments of coaxial cable connectors and associated washers. In one embodiment, for example, beveled expansion washers can be used to help secure male and female connectors together, thereby avoiding signal loss or degradation of electrical performance from loose connectors. In another embodiment, a washer can include one or more portions that are bent out of plane from a main body portion of the washer. The non-planar washer can be compressed as the male coaxial cable connector is threaded or otherwise joined with a corresponding female coaxial cable connector such that the non-planar portions of the washer bear against opposing surfaces of the male coaxial cable connector. The pressure concentrated at these contact points tends to prevent rotation of the two connectors, thereby preventing them from loosening or separating from vibration or use.

Certain details are set forth in the following description and in FIGS. 1-10E to provide a thorough understanding of various embodiments of the disclosure. Other details describing well-known structures and systems often associated with coaxial cable connectors have not been set forth in the following disclosure to avoid unnecessarily obscuring the description of the various embodiments of the invention. Many of the details, dimensions, angles, and other features shown in the Figures are merely illustrative of particular embodiments of the disclosure. Accordingly, other embodiments can have other details, dimensions, angles, and features without departing from the spirit or scope of the present disclosure. In addition, those of ordinary skill in the art will appreciate that further embodiments of the disclosure can be practiced without several of the details described below.

Figure 1:
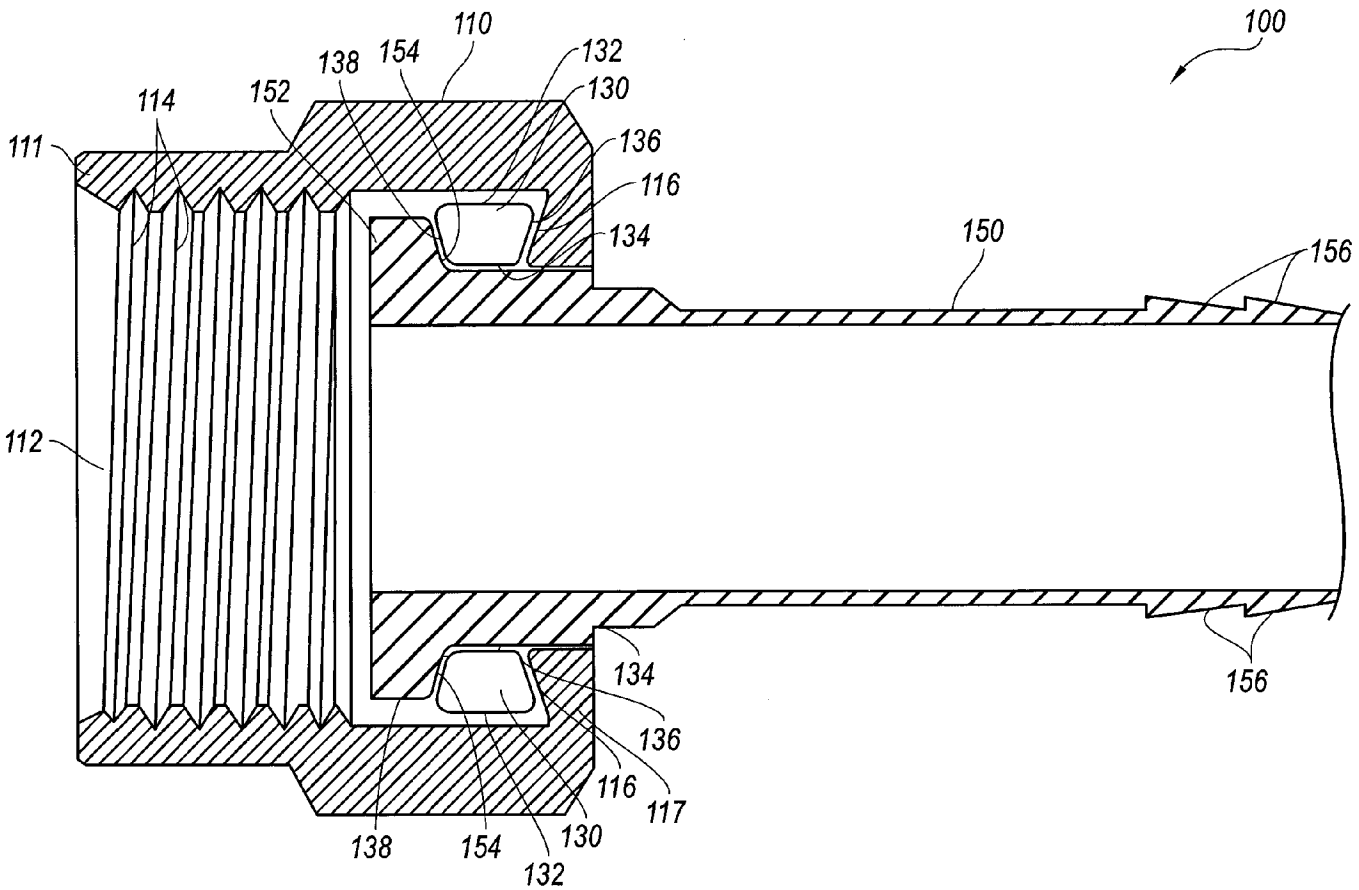
FIG. 1 is a partial, cross-sectional view of a male coaxial cable connector configured in accordance with an embodiment of the present technology prior to engaging a female coaxial cable connector.
Figure 2:
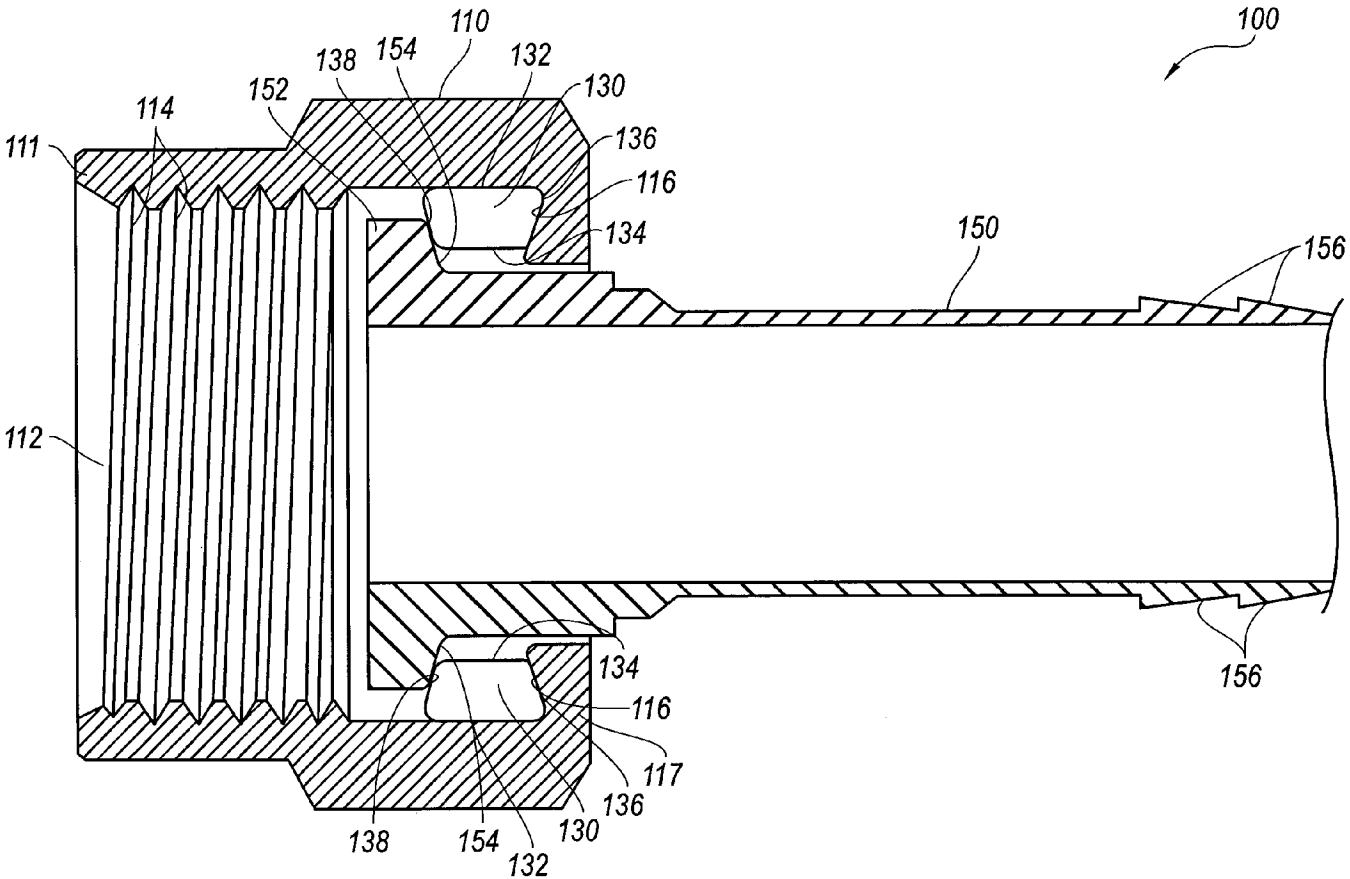
FIG. 2 is a partial, cross-sectional view of the male coaxial cable connector of FIG. 1 after the male coaxial cable connector has engaged a female coaxial cable connector in accordance with an embodiment of the present technology.

FIG. 1 is a partial, cross-sectional view of a male coaxial cable connector 100, e.g., a male F-connector, ("male connector 100") configured in accordance with an embodiment of the present technology prior to engagement with a female coaxial cable connector, e.g., a female F-connector, ("female connector," not shown), and FIG. 2 is a partial, cross-sectional view of the male connector 100 of FIG. 1 after engagement with the female connector. For purposes of clarity, the female connector is not shown in the Figures. Referring to FIGS. 1 and 2 together, the male connector 100 can include a conductive insert 150 with an annular flange 152 at least partially surrounded by a coupling nut 110. An expansion washer 130 ("washer 130") can be disposed between the annular flange 152 and the coupling nut 110. In the illustrated embodiment, the conductive insert 150 includes a pair of compression rings 156 for retaining the male connector 100 onto the end of a coaxial cable (not shown). In other embodiments, however, the male connector 100 may be crimped onto a coaxial cable using suitable methods known in the art. In various embodiments, the male connector 100 may also include an outer body (not shown) retaining the conductive insert 150 and juxtaposed the coupling nut 110.

As shown in the illustrated embodiment, the coupling nut 110 can include a first end portion 111, a second end portion 117, and an inner surface 112 defining a bore through which the female connector can be received. At least a portion of the inner surface 112 of the coupling nut 110 can include threads 114 for engaging corresponding threads on the female connector. In other embodiments, the coupling nut 110 can include other suitable features known in the art for engaging the male connector 100 with the corresponding female connector. In the illustrated embodiment, the second end portion 117 of the coupling nut 110 includes an angled surface 116 facing the annular flange 152 such that it presses against the washer 130 to expand it radially when the conductive insert 150 presses against the female connector (e.g., as the male connector 100 is tightened onto the female connector).

As shown in FIGS. 1 and 2, the bore of the coupling nut 110 can at least partially enclose the annular flange 152 of the conductive insert 150. In the illustrated embodiment, for example, the annular flange 152 is disposed between the first end portion 111 of the coupling nut 110 and the second end portion of 117 of the coupling nut 110. In various aspects of the present technology, the annular flange 152 can include an angled surface 154 facing the second end portion 117 of the coupling nut. The angled surface 154 can be configured to compress the washer 130 and expand it radially when the conductive insert 150 presses against the female connector.

As further shown in FIG. 1, the second end portion 117 of the coupling nut 110 and the flange 152 can form a groove in which the washer 130 is retained. The washer 130 can expand radially as the conductive insert 150 presses against the female connector (e.g., as the male connector 100 is tightened onto the female connector). In the illustrated embodiment, for example, a top surface 136 and a bottom surface 138 of the washer are compressed by the angled surfaces 116 and 154 of the coupling nut 110 and conductive insert 150, respectively. This presses an outer surface 132 of the washer 130 against the inner surface of the coupling nut 110, helping to hold the coupling nut 110 in place and inhibiting the male connector 100, and the female connector to which it attached, from separating.

The washer 130 may have various suitable sizes, shapes, and configurations, and may have a variety of desired properties such that the washer 130 radially expands when the conductive insert 150 is pressed against the female connector. As shown in FIGS. 1 and 2, for example, the washer 130 can be beveled or tapered such that the width of the inner surface 134 is less than the width of the outer surface 132. The inwardly tapered surfaces of the washer 130 can press against the opposing angled surfaces 116 and 154 of the coupling nut 110 and the annular flange, respectively, to facilitate radial expansion of the washer 130 as the male connector 100 is engaged with a female connector.

The washer 130 may be formed from suitable materials or combinations of materials, such as metal. For example, the washer 130 may be formed from steel, stainless steel, carbon steel, brass, copper, beryllium, other suitable metals, or combinations thereof. In various embodiments, the washer 130 is formed from a material that is both deformable (to radially expand) and resilient (to substantially return to its shape before compression when the male connector 100 is disengaged from the female connector). In one embodiment, for example, the washer 130 can be formed from a resilient elastomer, such as a natural or synthetic rubber (e.g., polychloroprene, nitrite, isoprene, acrylic, styrene-butadine, and combinations thereof).

Figure 3A:
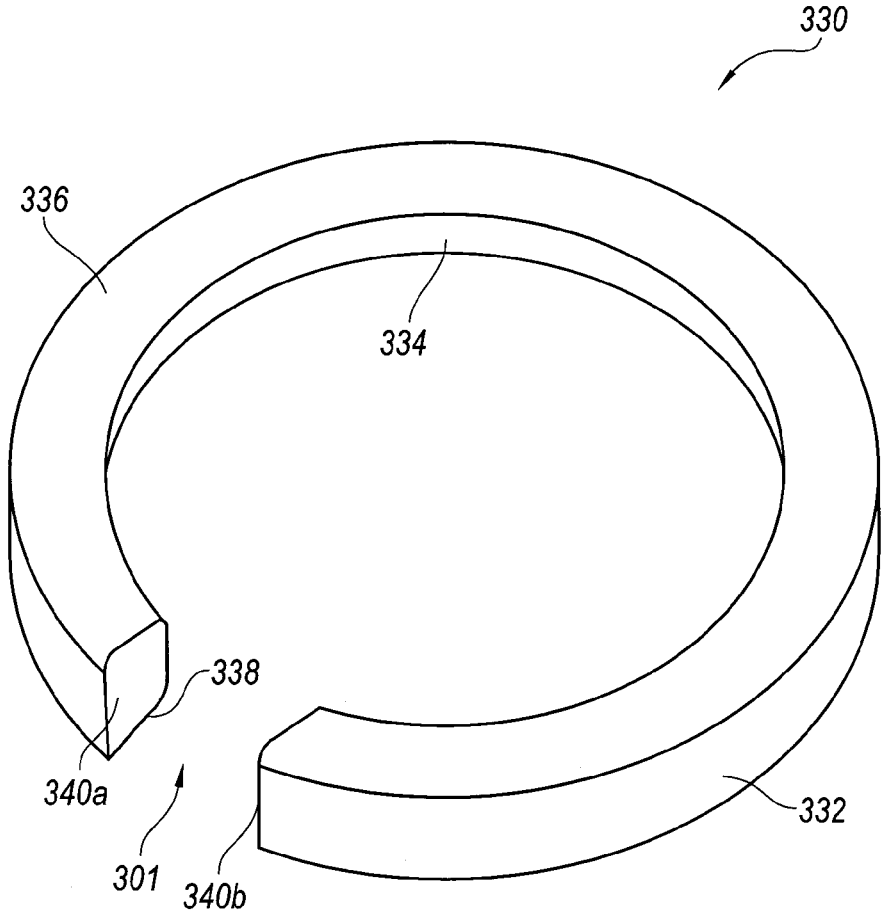
FIGS. 3A-3C are isometric views of expansion washers configured in accordance with embodiments of the present technology.
Figure 3B:
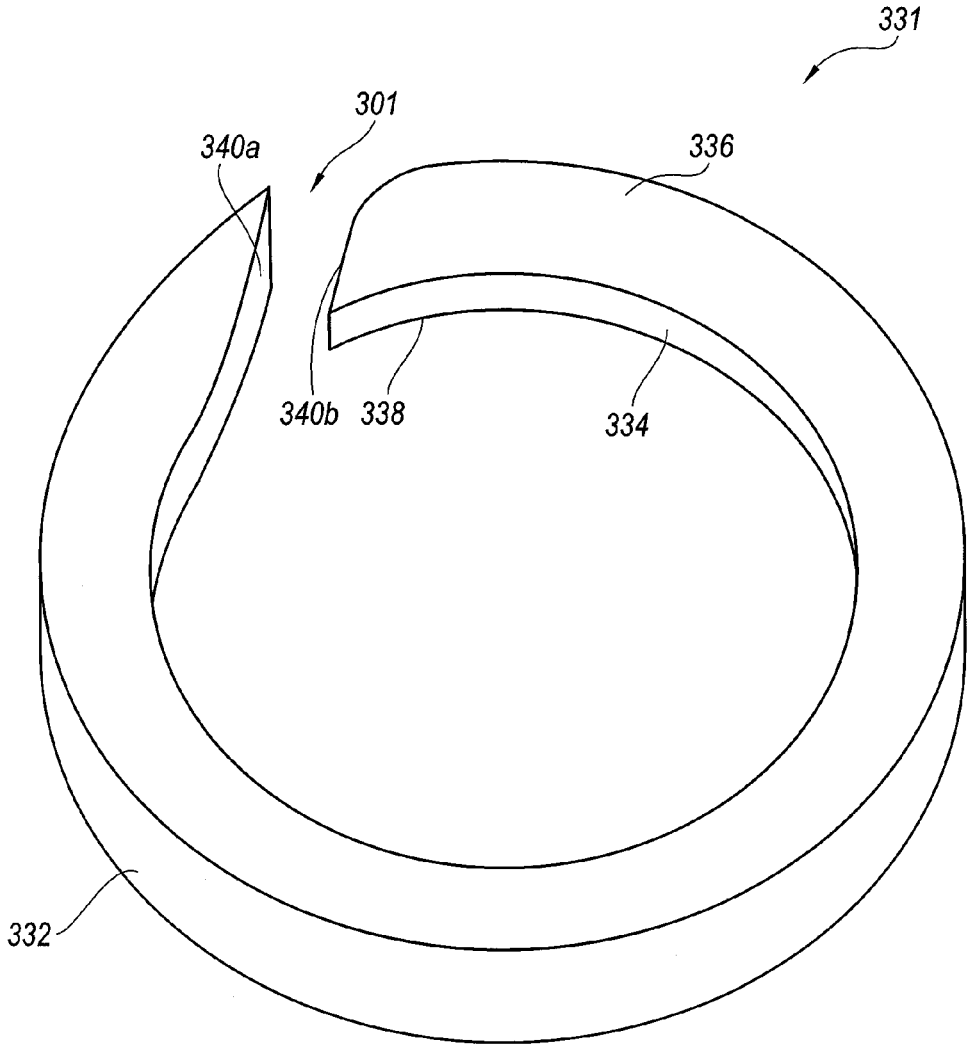
Figure 3C:
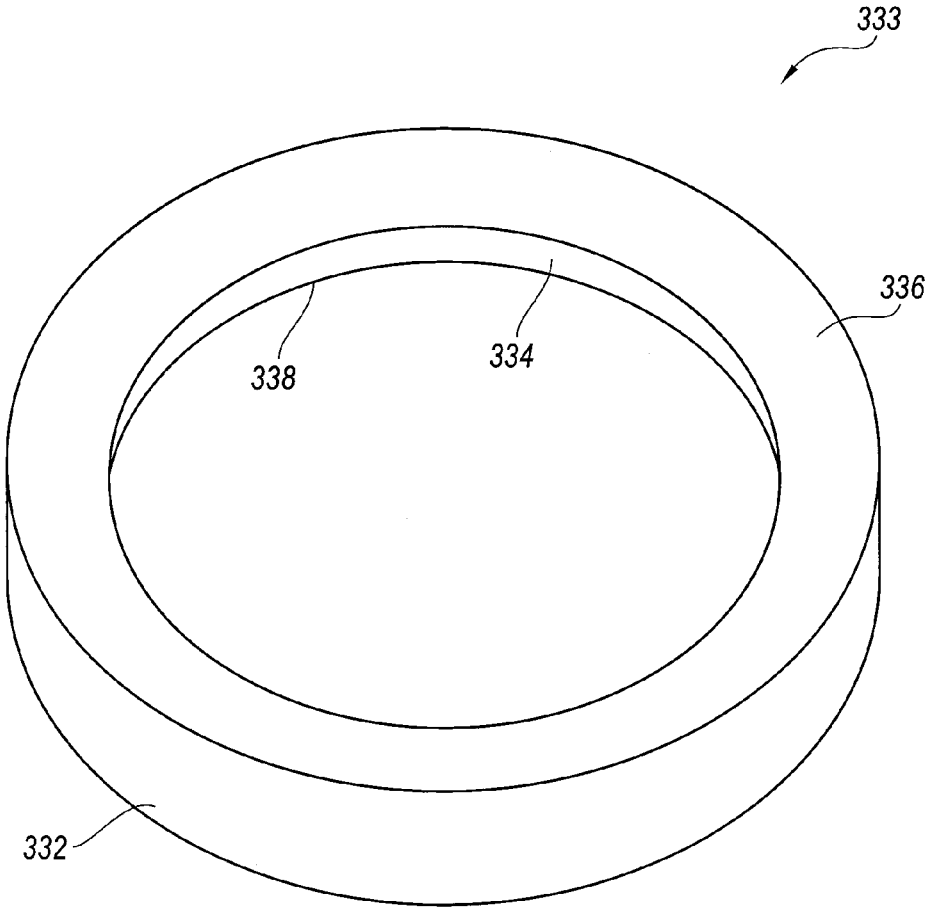

FIGS. 3A-3C are isometric views of expansion washers 330, 331 and 333, respectively, configured in accordance with embodiments of the present technology and suitable for use with the male connector 100 of FIGS. 1 and 2. Similar to the washer 130 described above, the washers 330, 331 and 333 have tapered edges such that the width of an inner surface 334 is less than the width of an outer surface 332. In the embodiments illustrated in FIGS. 3A and 3B, the washers 330 and 331 include a gap 301 spacing apart end portions 340 (identified individually as a first end portion 340*a* and a second end portion 340*b*) of the washers 330 and 331. As shown in FIG. 3B, the first end portion 340*a* can be chamfered. In other embodiments, both end portions 340 can be chamfered and/or have other suitable configurations. As shown in the embodiment illustrated in FIG. 3C, in further embodiments the washer 333 can be a continuous structure.

Figure 4:
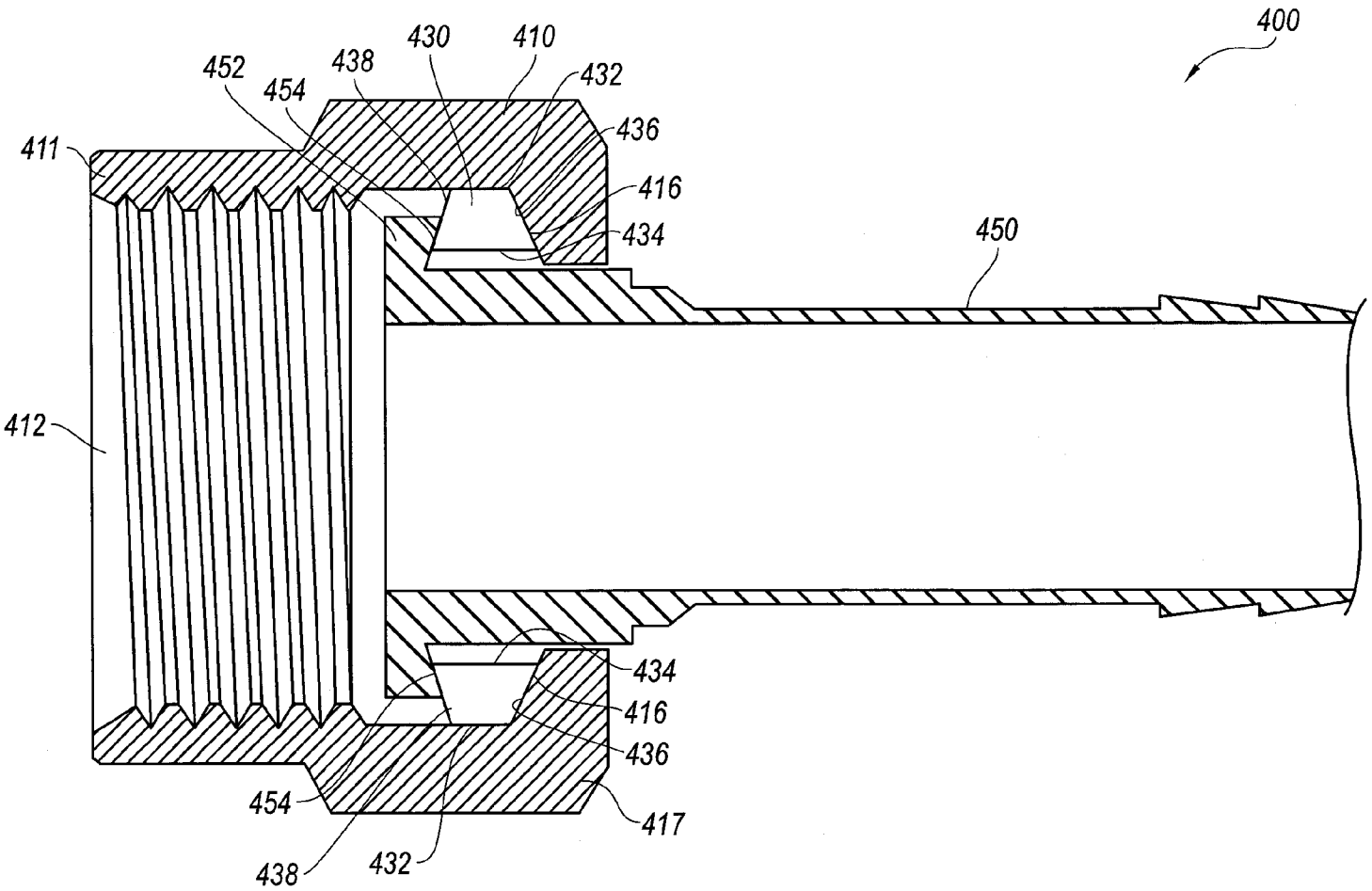
FIGS. 4 and 5 are partial, cross-sectional views of a male coaxial cable connector disengaged from a female coaxial cable connector and engaged with the female coaxial cable connector, respectively, in accordance with another embodiment of the present technology.
Figure 5:
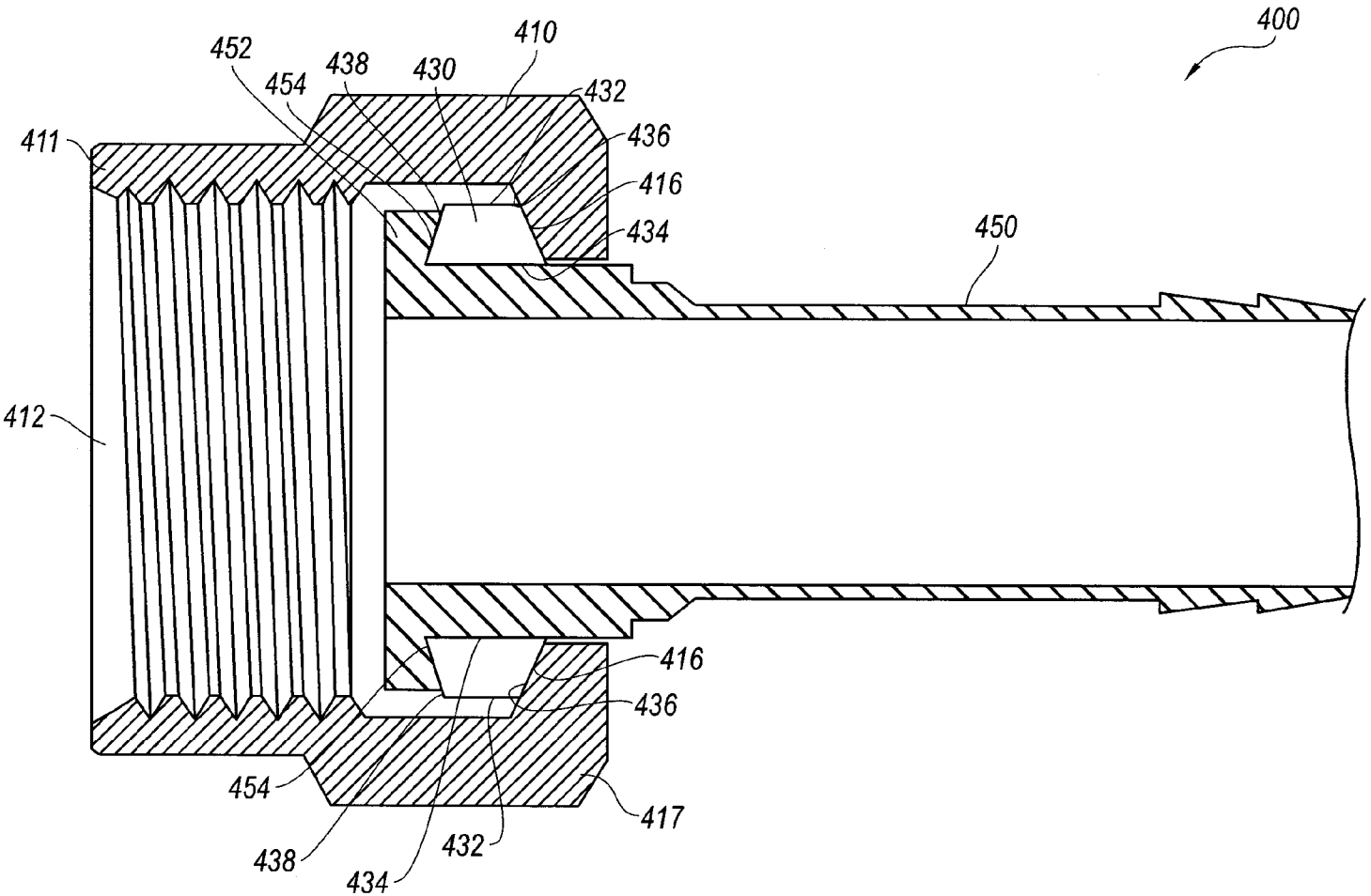

FIGS. 4 and 5 are partial, cross-sectional views of a male connector 400 disengaged from a female connector (not shown) and engaged with the female connector, respectively, in accordance with another embodiment of the present technology. The male connector 400 includes several features generally similar to the features of the male connector 100 described above with reference to FIGS. 1 and 2. The male connector 400 includes, for example, a conductive insert 450 having an annular flange 452 that is at least partially surrounded by a coupling nut 410. As shown in FIGS. 4 and 5, the male connector 400 includes a washer 430 having outwardly tapered edges such that the width of its inner surface 434 is greater than the width of its outer surface 432.

A second end portion 417 of the coupling nut 410 and the annular flange of the conductive insert 450 can include opposing angled surfaces 416 and 454, respectively, to engage a top surface 436 and a bottom surface 438 of the washer 430. As the conductive insert 450 presses against the female connector (e.g., when the male connector 400 engages the female connector), the washer 430 is driven radially inward such that the inner surface 434 of washer 430 is pressed against the conductive insert 450, helping to prevent the male connector 400, and the female connector to which it attached, from separating. In other embodiments, one or both the angled surfaces 416 and 454 of the coupling nut 410 and the annular flange 450, respectively, are not tapered such that the beveled washer 430 itself drives the washer 430 to press against the conductive insert 450.

Figure 6A:
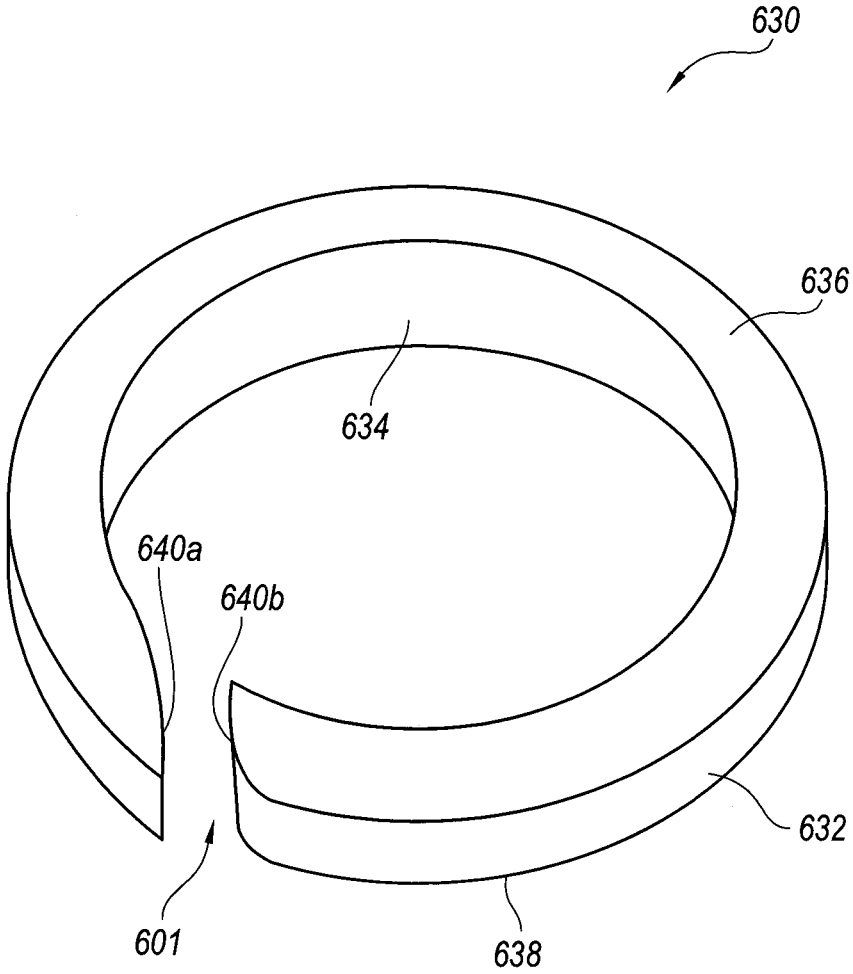
FIGS. 6A and 6B are perspective views of expansion washers configured in accordance with further embodiments of the present technology.
Figure 6B:
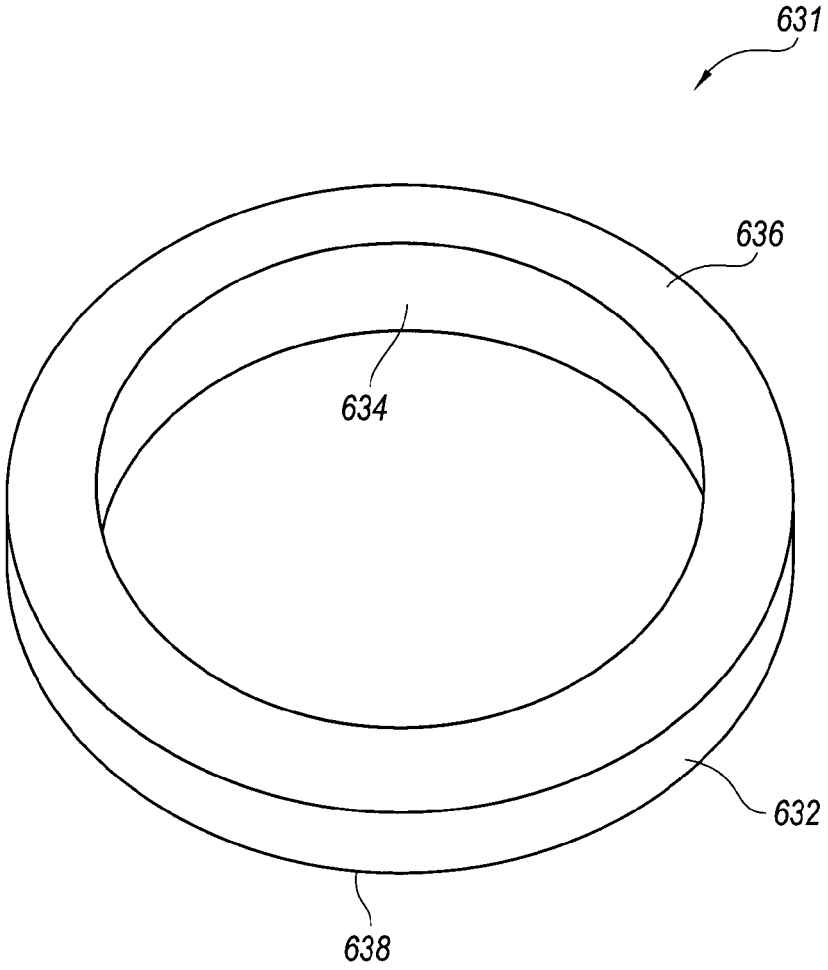

FIGS. 6A and 6B are isometric views of washers 630 and 631, respectively, configured in accordance with embodiments of the present disclosure and suitable for use with the male connector 400 of FIGS. 4 and 5. Similar to the washer 430 of FIGS. 4 and 5, the washers 630 and 631 are tapered such that the width of an inner surface 634 is greater than the width of the outer surface 632. As shown in FIG. 6A, in various embodiments, the washer 630 can include a gap 601 separating end portions 640 (identified individually as a first end portion 640*a* and a second end portion 640*b*). In other embodiments, the washer 631 can be continuous (FIG. 6B).

Figure 7A:
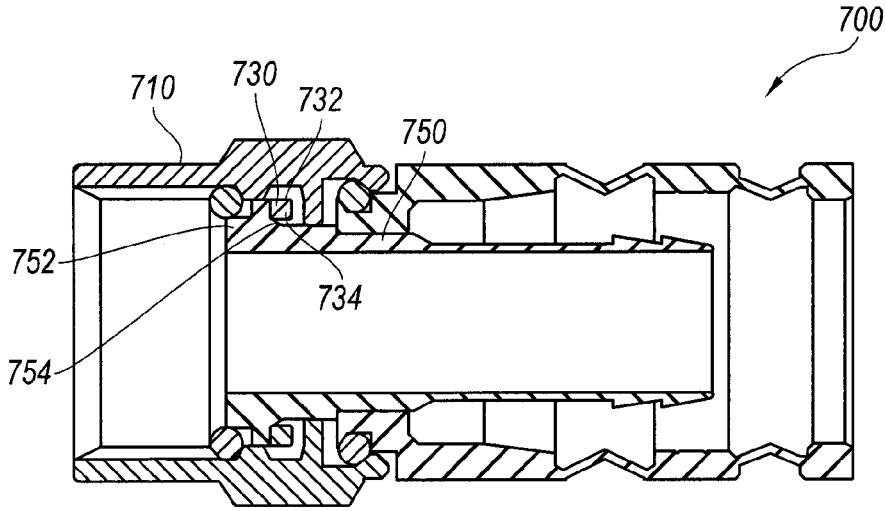
FIGS. 7A and 7B are partial, cross-sectional views of a male coaxial cable connector disengaged from a female coaxial cable connector and engaged with a female coaxial cable connector, respectively, in accordance with yet another embodiment of the present technology.
Figure 7B:
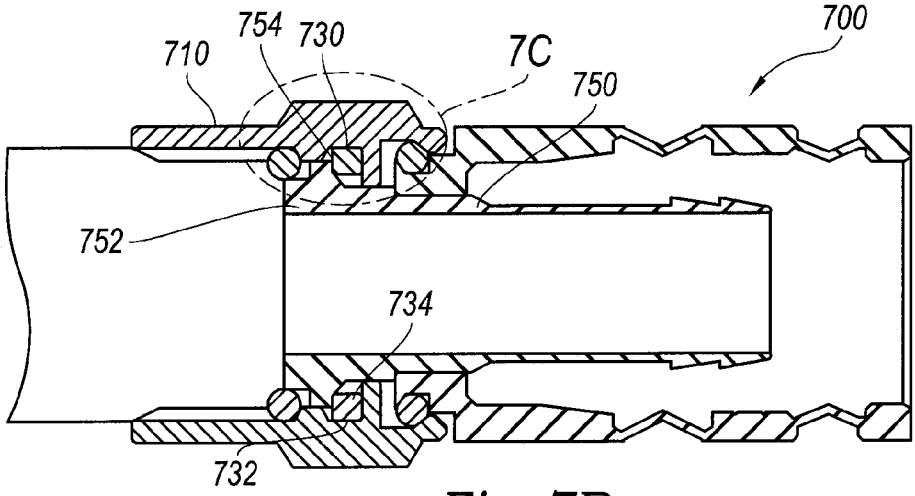
Figure 7C:
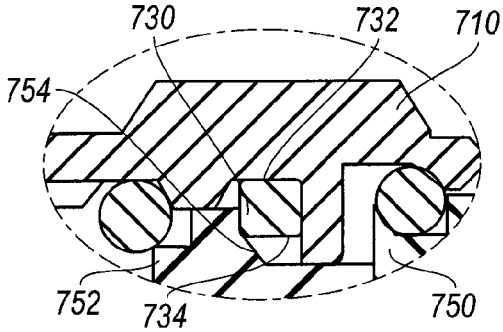
FIG. 7C is an enlarged cross-sectional view of a portion of the engaged male and female coaxial cable connectors of FIG. 7B.

FIGS. 7A-7C illustrate a series of cross-sectional views of a connector 700 configured according to various aspects of the present technology. In this embodiment, the connector 700 includes a flat expansion washer 730 ("washer 730") having an inner surface 734 and an outer surface 732 of substantially equal widths. FIG. 7A shows the washer 730 before connector 700 is engaged with a corresponding female connector (not shown). FIG. 7B (from which enlarged FIG. 7C is taken) shows the washer 730 compressed between a coupling nut 710 and a flange 752 of a conductive insert 750 when the connector 700 is engaged with a corresponding female connector 751. As best seen in the enlarged view of FIG. 7C, the washer 730 radially expands as an angled surface 754 of the flange 752 of the conductive insert 750 presses outwardly against a corner of the inner surface 734.

Figure 8A:
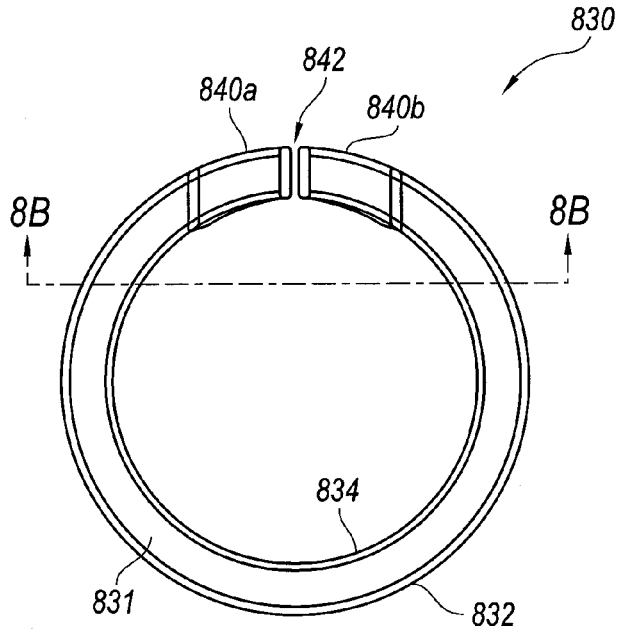
FIGS. 8A-8C are top plan, partial cross-sectional and isometric views, respectively, of a cable connector washer configured in accordance with a further embodiment of the present technology.
Figure 8B:
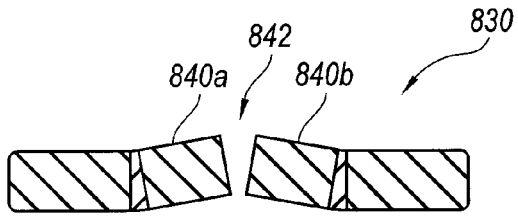
Figure 8C:
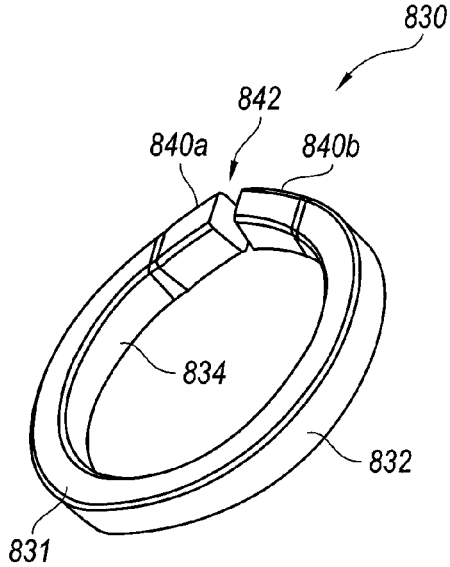

FIGS. 8A-8C are top plan, partial cross-sectional, and perspective views, respectively, of a washer 830 configured in accordance with an additional embodiment of the present technology. Referring to FIGS. 8A-8C together, the washer 830 can include a generally flat and annular body portion 831 having an outer surface 832 and an inner surface 834. In an aspect of this embodiment, the washer 830 further includes opposing end portions 840 (identified individually as a first end portion 840*a* and a second end portion 840*b*) separated by a gap 842. In one embodiment, the washer 830 can have an outer diameter of approximately 8.6 mm and the gap 842 can have a width of approximately 0.3 mm at its narrowest point. In other embodiments, however, the gap 842 and/or the washer 830 can have other dimensions depending on various factors, such as the size of the coupling nut 110, the type of insert used, etc. For example, in one other embodiment the washer 830 can be semicircular such that the gap 842 has a width approximately equal to the diameter of the inner surface 834. As shown in FIG. 8C, the outer surface 832 and the inner surface 834 can have substantially equal widths. In other embodiments, however, the washer 830 can be tapered or beveled as shown in, for example, FIGS. 3A-3C, 6A, and 6B. In further embodiments, the outer surface 832 and the inner surface 834 can have other suitable configurations that facilitate the mating of coaxial cable connectors.

As shown in FIGS. 8B and 8C, the end portions 840 of the washer 830 can be bent or otherwise formed out of plane relative to the body portion 831 of the washer 830. For example, the end portions 840 can be bent at approximately 10° relative to the plane of the body portion 831. In other embodiments, the end portions 840 can be bent at different angles relative to the body portion 831. In further embodiments, the end portions 840 can be bent in opposite directions such that the first end portion 840*a* extends in a first direction and the second end portion 840*b* extends in a second direction different from the first direction. In still further embodiments, one of the first and second end portions 840*a, b* can be bent while the other end portion can remain planar relative to the body portion 831.

Similar to the washers described above, the washer 830 can be made from steel, stainless steel, carbon steel, brass, copper, and/or other suitable metals known in the art. In other embodiments, the washer 830 can be made from a resilient elastomer, such as a natural or synthetic rubber and/or other suitable resilient materials. In selected embodiments, the washer 830 can be formed using a mold that includes non-planar portions that create the end portions 840. In other embodiments, the washer 830 can be molded or otherwise formed as a substantially planar washer, and subsequently deformed to include the non-planar end portions 840. In further embodiments, the washer 830 can be manufactured using other suitable methods of fabricating washers.

Figure 9A:
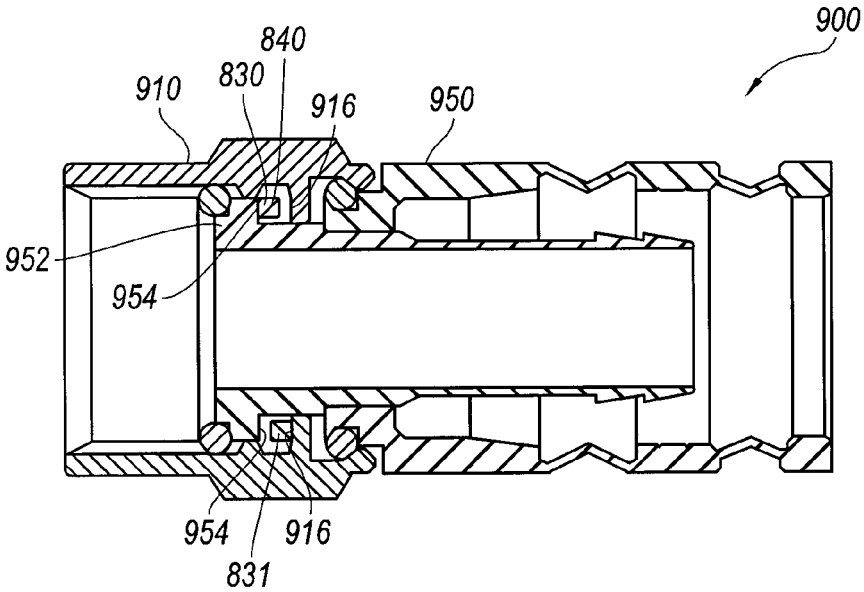
FIG. 9A is a cross-sectional view of a male coaxial cable connector configured in accordance with another embodiment of the present technology.

FIG. 9A is a cross-sectional view of a male coaxial cable connector 900, e.g., a male F-connector, ("male connector 900") configured in accordance with an embodiment of the present technology. Similar to the male connectors described above, the male connector 900 includes a conductive insert 950 with an annular flange 952 at least partially disposed in a coupling nut 910. The male connector 900 can further include the washer 830 of FIGS. 8A-8C positioned between a surface 954 of the annular flange 952 and a surface 916 of the coupling nut 910. In the illustrated embodiment, the non-planar end portions 840 can abut the surface 954 of the annular flange 952, and the body portion 831 can abut the surface 916 of the coupling nut 910, or vice versa.

When the male connector 900 is tightened (e.g., threaded) onto a female connector (not shown), the surface 916 of the coupling nut 910 compresses the washer 830 against the opposing back portion 154 of the annular flange 152. As a result, the non-planar end portions 840 bear against the opposing surfaces 916 and 954. The pressure exerted by the end portions 840 tends to grip the male connector 900 and inhibit its rotation such that the mated connectors remain securely fastened. Additionally, the compressed washer 830 can exert a tension between the opposing surfaces 916 and 954 that also holds the male connector 900 firmly in place against the corresponding female connector to resist or prevent loosening of the connectors during vibration, thermal cycling, and/or other potential separation causing events. In selected embodiments, the coupling nut 910 and/or the annular flange 952 can include angled portions to radially expand the washer 830.

Figure 9B:
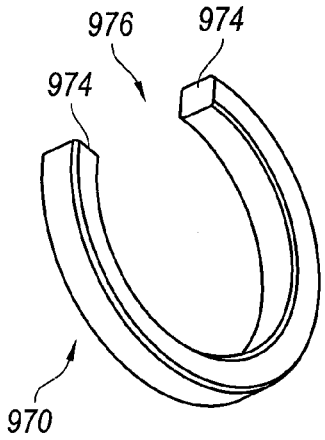
FIGS. 9B and 9C are isometric views of cable connector washers configured in accordance with other embodiments of the present technology.
Figure 9C:
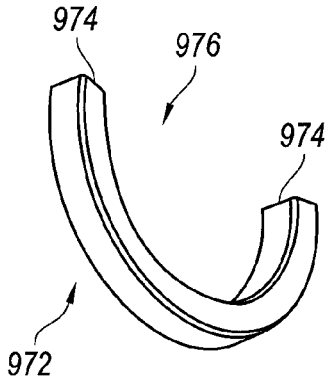

FIGS. 9B and 9C are isometric views of washers 970 and 972 that are twisted along their circumferences such that the washers 970 and 972 are non-planar. Similar to the non-planar washer 830 described above, the washers 970 and 972 apply concentrated pressures to portions of the male connector 900. This can resist relative rotation of the mating parts and hold the male connector 900 firmly in place against the corresponding female connector to resist or prevent loosening of the connectors. Additionally, the washers 970 and 972 can include opposing end portions 874 separated by gaps 876 of varying lengths. In other embodiments, the washers 970 and 972 are continuous and include portions twisted, bent, or otherwise formed out of plane with one another.

Figure 10A:
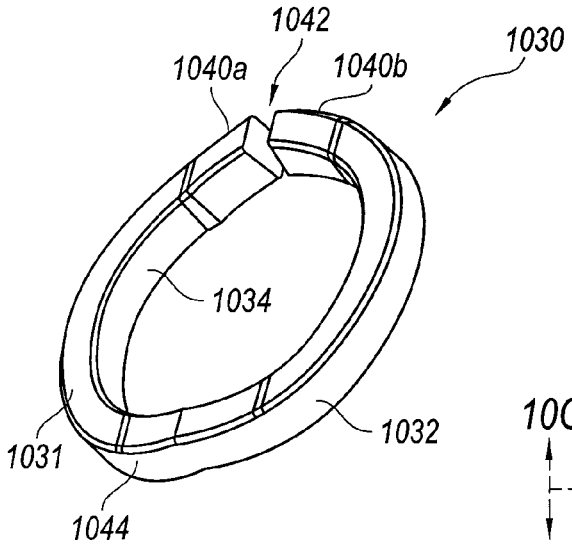
FIGS. 10A-10E are a series of views illustrating a cable connector washer configured in accordance with a further embodiment of the present technology.
Figure 10B:
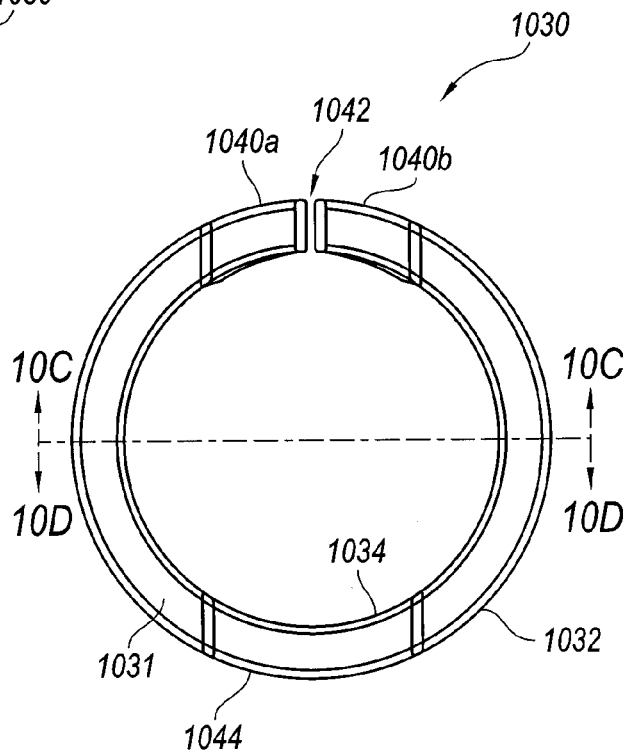
Figure 10C:
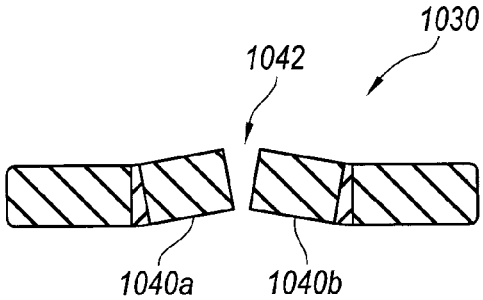
Figure 10D:
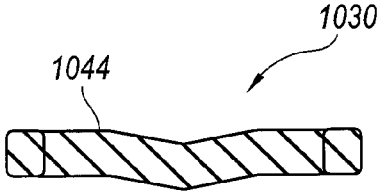
Figure 10E:
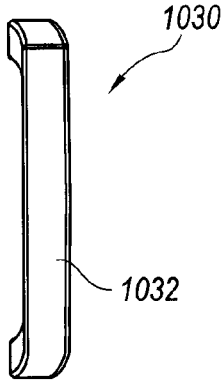

FIGS. 10A-10E show isometric, top plan, side cross-sectional, side cross-sectional and side views, respectively, of a washer 1030 configured in accordance with another embodiment of the present technology. The washer 1030 includes features generally similar to the features of the washer 830 described above with reference to FIGS. 8A-8C. For example, the washer 1030 includes a body portion 1031 having an inner surface 1034, an outer surface 1032, and non-planar first and second end portions 1040*a, b* separated from one another by a gap 1042. As shown in FIGS. 10A and 10D, the washer 1030 further includes a non-planar portion 1044 along the circumference of the washer 1030 generally opposite the end portions 1040. The non-planar portion 1044 can be bent or otherwise formed out of plane from the body portion 1031 in the same direction as the end portions 1040. In other embodiments, the non-planar portion 1044 and the end portion 1040 can be bent in opposite directions. Similar to the washer 830 described with reference to FIGS. 8A-8C, compressing the washer 1030 causes areas of concentrated pressure that grip the male connector and hold it firmly in place against the corresponding female connector to resist or prevent loosening of the connectors. The additional non-planar portion 1030 can provide additional areas of high pressure to further resist or prevent the male and female connectors from loosening. In further embodiments, the washer 1030 includes additional non-planar portions 1044 around the circumference of the washer 1030.

From the foregoing, it will be appreciated that specific embodiments of the technology have been described herein for purposes of illustration, but that various modifications may be made without deviating from the spirit and scope of the various embodiments of the invention. For example, the washers described above with reference to FIGS. 8A-10E can be continuous and therefore do not include the gap between the opposing end portions. Additionally, the dimensions shown in the Figures are merely examples of dimensions for coaxial cable connectors and washers. In other embodiments, the washers and coaxial cable connectors may have different dimensions suitable for cable connector washers. Further, while various advantages associated with certain embodiments of the technology have been described above in the context of those embodiments, other embodiments may also exhibit such advantages, and not all embodiments need necessarily exhibit such advantages to fall within the scope of the technology.

I claim:

1. A first coaxial cable connector, comprising:

a coupling nut having a first end portion, a second end portion, and an inner surface defining a bore for receiving a corresponding second coaxial cable connector;

a conductive insert having an annular flange positioned at least partially in the bore; and a washer positioned between the second end portion of the coupling nut and the annular flange, wherein at least a portion of the washer is configured to press against at least one of the annular flange and the second end portion of the coupling nut to restrict rotation of the coupling nut with respect to the conductive insert, wherein at least one of the second end portion of the coupling nut and the annular flange includes an angled surface facing the washer, and wherein the angled surface is configured to drive the washer to expand radially outward toward the coupling nut when the conductive insert presses against the corresponding second coaxial cable connector.

2. The first coaxial cable connector of claim 1 wherein the washer has a circumference and opposing end portions separated by a gap, and wherein the washer is twisted along the circumference such that the end portions are out of plane with one another.

3. A first coaxial cable connector, comprising:

a coupling nut having a first end portion, a second end portion, and an inner surface defining a bore for receiving a corresponding second coaxial cable connector;

a conductive insert having an annular flange positioned at least partially in the bore; and a washer positioned between the second end portion of the coupling nut and the annular flange, wherein at least a portion of the washer is configured to press against at least one of the annular flange and the second end portion of the coupling nut to restrict rotation of the coupling nut with respect to the conductive insert, wherein at least one of the second end portion of the coupling nut and the annular flange includes an angled surface facing the washer, and wherein the angled surface is configured to drive the washer radially inward toward the conductive insert when the conductive insert presses against the corresponding second coaxial cable connector.

4. A first coaxial cable connector, comprising:

a coupling nut having a first end portion, a second end portion, and an inner surface defining a bore for receiving a corresponding second coaxial cable connector;

a conductive insert having an annular flange positioned at least partially in the bore; and a washer positioned between the second end portion of the coupling nut and the annular flange, wherein at least a portion of the washer is configured to press against at least one of the annular flange and the second end portion of the coupling nut to restrict rotation of the coupling nut with respect to the conductive insert, wherein the washer includes an inner surface having a first width and an outer surface having a second width, and wherein the first width is greater than the second width.

5. The first coaxial cable connector of claim 4 wherein:

the coaxial cable connector is a male coaxial cable connector;

the corresponding second coaxial cable connector is a female coaxial cable connector;

the inner surface of the coupling nut is at least partially threaded to engage threads on the opposing female coaxial cable connector; and the coupling nut and the annular flange include opposing surfaces angled inward toward the conductive insert.

6. A first coaxial cable connector, comprising:

a coupling nut having a first end portion, a second end portion, and an inner surface defining a bore for receiving a corresponding second coaxial cable connector;

a conductive insert having an annular flange positioned at least partially in the bore; and a washer positioned between the second end portion of the coupling nut and the annular flange, wherein at least a portion of the washer is configured to press against at least one of the annular flange and the second end portion of the coupling nut to restrict rotation of the coupling nut with respect to the conductive insert, wherein the washer includes an inner surface having a first width and an outer surface having a second width, and wherein the first width is less than the second width.

7. The first coaxial cable connector of claim 6 wherein:

the coaxial cable connector is a male coaxial cable connector;

the corresponding second coaxial cable connector is a female coaxial cable connector;

the inner surface of the coupling nut is at least partially threaded to engage threads on the opposing female coaxial cable connector; and the coupling nut and the annular flange include opposing surfaces angled outward toward the coupling nut.

8. A first coaxial cable connector, comprising:

a coupling nut having a first end portion, a second end portion, and an inner surface defining a bore for receiving a corresponding second coaxial cable connector;

a conductive insert having an annular flange positioned at least partially in the bore; and a washer positioned between the second end portion of the coupling nut and the annular flange, wherein at least a portion of the washer is configured to press against at least one of the annular flange and the second end portion of the coupling nut to restrict rotation of the coupling nut with respect to the conductive insert, wherein the washer includes opposing end portions that define a gap between the opposing end portions, and wherein the washer is tapered between an outer surface and an inner surface.

9. A first coaxial cable connector, comprising:

a coupling nut having a first end portion, a second end portion, and an inner surface defining a bore for receiving a corresponding second coaxial cable connector;

a conductive insert having an annular flange positioned at least partially in the bore; and a washer positioned between the second end portion of the coupling nut and the annular flange, wherein at least a portion of the washer is configured to press against at least one of the annular flange and the second end portion of the coupling nut to restrict rotation of the coupling nut with respect to the conductive insert, wherein the washer includes a body portion and opposing end portions separated by a gap, the opposing end portions being in a different plane than the body portion, and wherein the body portion and the end portions are configured to grip opposing surfaces of the annular flange and the coupling nut to resist rotation of the coupling nut with respect to the conductive insert.

10. The first coaxial cable connector of claim 9 wherein the washer includes a non-planar portion along a circumference of the washer, and wherein the body portion and the non-planar portion are configured to bear against opposing surfaces of the annular flange and the coupling nut when the conductive insert presses against the corresponding second coaxial cable connector.

11. A method of manufacturing a first coaxial cable connector, the method comprising:

positioning a washer around an annular flange of a conductive insert;

positioning the annular flange and the washer at least partially into a bore of a coupling nut, wherein opposing surfaces of the coupling nut and the annular flange form a groove in which the washer is retained, and wherein the washer is configured to restrict rotational movement of the coupling nut with respect to the conductive insert when the conductive insert is pressed against a corresponding second coaxial cable connector; and forming an angled surface on at least one of the opposing surfaces of the annular flange and the coupling nut, wherein the angled surface is tapered inward toward the conductive insert.

12. The method of claim 11, further comprising:

forming the washer to include a body portion and opposing end portions separated by a gap; and forming at least one of the end portions out of plane with the body portion.

13. The method of claim 12, further comprising forming a non-planar portion along a circumference of the washer.

14. A method of manufacturing a first coaxial cable connector, the method comprising:

positioning a washer around an annular flange of a conductive insert;

positioning the annular flange and the washer at least partially into a bore of a coupling nut, wherein opposing surfaces of the coupling nut and the annular flange form a groove in which the washer is retained, and wherein the washer is configured to restrict rotational movement of the coupling nut with respect to the conductive insert when the conductive insert is pressed against a corresponding second coaxial cable connector; and forming an angled surface on at least one of the opposing surfaces of the annular flange and the coupling nut, wherein the angled surface is tapered outward toward the coupling nut.

15. A method of manufacturing a first coaxial cable connector, the method comprising:

positioning a washer around an annular flange of a conductive insert;

positioning the annular flange and the washer at least partially into a bore of a coupling nut, wherein opposing surfaces of the coupling nut and the annular flange form a groove in which the washer is retained, and wherein the washer is configured to restrict rotational movement of the coupling nut with respect to the conductive insert when the conductive insert is pressed against a corresponding second coaxial cable connector; and forming the washer to include an inner surface having a first width and an outer surface having a second width less than the first width.

16. A method of manufacturing a first coaxial cable connector, the method comprising:

positioning a washer around an annular flange of a conductive insert;

positioning the annular flange and the washer at least partially into a bore of a coupling nut, wherein opposing surfaces of the coupling nut and the annular flange form a groove in which the washer is retained, and wherein the washer is configured to restrict rotational movement of the coupling nut with respect to the conductive insert when the conductive insert is pressed against a corresponding second coaxial cable connector; and forming the washer to include an inner surface having a first width and an outer surface having a second width greater than the first width.

* * * * *